US010451374B2

(12) United States Patent
Palu et al.

(10) Patent No.: US 10,451,374 B2
(45) Date of Patent: Oct. 22, 2019

(54) NOISE SUPPRESSOR FOR FIREARM AND BLANK FIRING ADAPTER FOR FIREARM

(71) Applicant: Thunder Beast Arms Corporation, Cheyenne, WY (US)

(72) Inventors: Kurtis A. Palu, Wellington, CO (US); Sutherland Detweiler, Cheyenne, WY (US); Michael S. Coppinger, Cheyenne, WY (US)

(73) Assignee: Thunder Beast Arms Corporation, Cheyenne, WY (US)

( * ) Notice: Subject to any disclaimer, the term of this patent is extended or adjusted under 35 U.S.C. 154(b) by 46 days.

(21) Appl. No.: 15/984,601

(22) Filed: May 21, 2018

(65) Prior Publication Data

US 2018/0340749 A1 Nov. 29, 2018

Related U.S. Application Data

(60) Provisional application No. 62/510,868, filed on May 25, 2017.

(51) Int. Cl.
*F41A 21/30* (2006.01)
*F41A 21/26* (2006.01)
*F41A 17/44* (2006.01)

(52) U.S. Cl.
CPC ..... *F41A 21/30* (2013.01); *F41A 21/26* (2013.01); *F41A 17/44* (2013.01)

(58) Field of Classification Search
CPC ..... F41A 21/30; F41A 21/26; F41A 17/44; F41A 33/00
USPC ..... 89/14.4, 14.5
See application file for complete search history.

(56) References Cited

U.S. PATENT DOCUMENTS 3,360,880 A * 1/1968 Finnegan ..... F41A 17/44 42/66
3,744,370 A * 7/1973 Snodgrass ..... F41A 21/26 89/14.5
3,766,822 A * 10/1973 Sophinos ..... F41A 21/26 89/14.5
3,786,895 A 1/1974 Perrine
4,128,040 A * 12/1978 Schuetz ..... F41A 21/26 89/14.5
4,576,083 A 3/1986 Seberger, Jr.
4,907,488 A 3/1990 Seberger
(Continued)

FOREIGN PATENT DOCUMENTS

WO WO 1997/007375 A2 2/1997
WO WO 2011/035111 A1 3/2011

*Primary Examiner* — Joshua E Freeman
(74) *Attorney, Agent, or Firm* — Adsero IP

(57) ABSTRACT

A noise suppressor for a firearm is provided that can be disassembled and is able to withstand full automatic fire. In various embodiments, a noise suppressor might include an outer tube, a distal end cap, and a pin(s). The outer tube might include a plurality of first holes spaced apart from each other along a circumference of a distal end of the outer tube. The distal end cap might include a plurality of second holes spaced apart from each other along a circumference of the distal end cap. One of the distal end cap or the distal end might be threaded into the other. Each of the pin(s) might be releasably inserted and affixed to at least one first hole and at least one second hole. A blank firing adapter is also provided that can be coupled to the noise suppressor (and can withstand live rounds being fired into it).

28 Claims, 7 Drawing Sheets

(56) References Cited

U.S. PATENT DOCUMENTS 5,099,596 A * 3/1992 Butler, Jr. ..... F41A 17/74 42/70.11
5,140,893 A * 8/1992 Leiter ..... F41A 21/26 89/14.5
5,433,133 A 7/1995 La France
6,176,032 B1 * 1/2001 Cohen ..... F41A 17/44 42/96
6,308,609 B1 10/2001 Davies
6,374,718 B1 4/2002 Rescigno et al.
6,948,415 B2 9/2005 Matthews et al.
6,973,863 B1 * 12/2005 Jones ..... F41A 21/26 89/14.2
7,062,874 B1 6/2006 Smith
7,237,467 B1 7/2007 Melton
7,308,967 B1 12/2007 Hoel
D582,502 S 12/2008 Brittingham
D582,503 S 12/2008 Brittingham
D584,786 S 1/2009 Brittingham
D584,787 S 1/2009 Brittingham
D585,518 S 1/2009 Brittingham
D591,382 S 4/2009 Brittingham
7,587,969 B2 9/2009 Silvers
7,588,122 B2 9/2009 Brittingham
7,594,464 B2 9/2009 Dueck
7,600,606 B2 10/2009 Brittingham
7,610,710 B2 11/2009 Brittingham
7,610,992 B2 11/2009 Brittingham
7,661,349 B1 2/2010 Brittingham
7,676,976 B2 3/2010 Dueck et al.
7,743,693 B1 6/2010 Brittingham
7,789,009 B1 9/2010 Brittingham
7,832,323 B1 11/2010 Davies
7,856,914 B2 12/2010 Shults et al.
7,874,238 B2 1/2011 Silvers
7,891,282 B1 2/2011 DeGroat
7,905,171 B1 3/2011 Brittingham
7,946,069 B2 5/2011 Dueck et al.
D639,375 S 6/2011 Oliver
D642,648 S 8/2011 Oliver
D642,649 S 8/2011 Oliver
D642,650 S 8/2011 Oliver
D643,087 S 8/2011 Oliver
7,987,944 B1 8/2011 Brittingham et al.
8,087,338 B1 1/2012 Hines
8,091,462 B2 1/2012 Dueck et al.
8,096,222 B2 1/2012 Silvers
8,100,224 B1 1/2012 Olson
8,162,100 B2 4/2012 Shults et al.
8,167,084 B1 5/2012 Moore
8,196,701 B1 6/2012 Oliver
8,201,487 B2 6/2012 Dueck et al.
8,209,895 B2 7/2012 Dueck et al.
8,272,306 B1 9/2012 Smith
8,286,750 B1 10/2012 Oliver
8,342,071 B2 * 1/2013 Hortobagyi ..... F41A 21/34 89/14.2
D677,357 S 3/2013 Dueck et al.
8,387,299 B1 3/2013 Brittingham et al.
8,397,862 B2 3/2013 Shand
8,424,441 B2 4/2013 Brittingham et al.
D682,974 S 5/2013 Honigmann
D682,975 S 5/2013 Honigmann
8,439,155 B2 5/2013 Shults et al.
D683,806 S 6/2013 Dueck
8,453,789 B1 6/2013 Honigmann et al.
8,459,405 B1 6/2013 Dueck
8,459,406 B1 6/2013 Dueck
8,474,361 B2 7/2013 Brittingham
8,490,535 B1 7/2013 Moore et al.
8,499,676 B1 * 8/2013 Moore ..... F41A 21/26 42/90
8,505,431 B2 8/2013 Hines
8,505,680 B2 8/2013 Dueck
8,516,941 B1 8/2013 Oliver
8,528,691 B1 9/2013 Carmichael et al.
8,539,708 B2 9/2013 Kenney et al.
8,555,765 B2 10/2013 Graham et al.
8,567,556 B2 10/2013 Dueck et al.
8,579,075 B2 11/2013 Brittingham et al.
8,584,794 B2 11/2013 Dueck
8,714,301 B2 5/2014 Shults
8,739,922 B2 6/2014 Wirth et al.
8,763,510 B2 7/2014 Dueck et al.
8,770,084 B2 7/2014 Young
8,826,793 B2 9/2014 Oliver
8,881,862 B1 11/2014 Messer, Jr. et al.
8,939,057 B1 1/2015 Edsall
8,950,310 B2 2/2015 Storrs
8,950,546 B2 2/2015 Shults et al.
8,973,481 B2 3/2015 Dueck et al.
8,991,551 B2 3/2015 Latka
9,194,640 B2 11/2015 Wirth et al.
9,239,201 B1 1/2016 Green
9,261,317 B2 2/2016 Daniel et al.
9,291,417 B2 3/2016 James
9,316,456 B1 4/2016 Oliver
9,347,727 B1 5/2016 Cler
9,366,495 B1 6/2016 Coppinger et al.
9,400,151 B1 7/2016 Edsall
9,500,427 B1 11/2016 LaRue
9,506,710 B2 11/2016 Smith
9,513,078 B1 12/2016 Fulton et al.
9,593,899 B2 3/2017 Coppinger et al.
9,658,019 B2 5/2017 Smith
9,719,745 B2 8/2017 Palu et al.
9,784,517 B2 * 10/2017 Pittman ..... F41A 17/02
10,054,382 B2 8/2018 Palu et al.
2003/0022135 A1 * 1/2003 Shechter ..... F41A 21/26 434/16
2003/0221351 A1 * 12/2003 Barber ..... F41A 17/44 42/70.11
2004/0200114 A1 * 10/2004 Milo ..... F41A 17/44 42/70.11
2006/0162221 A1 * 7/2006 McLaren ..... F41A 17/44 42/70.11
2008/0047187 A1 * 2/2008 Ramsey ..... F41A 17/44 42/70.11
2008/0086927 A1 * 4/2008 Wajdic ..... F41A 17/44 42/70.11
2010/0126334 A1 5/2010 Shults et al.
2010/0180759 A1 7/2010 Petersen
2011/0056111 A1 3/2011 Brittingham
2011/0067950 A1 3/2011 Shults et al.
2012/0030982 A1 * 2/2012 Inskeep ..... F41A 17/44 42/70.01
2012/0103176 A1 * 5/2012 Latka ..... F41A 21/30 89/14.4
2012/0145478 A1 * 6/2012 Brittingham ..... F41A 21/30 181/223
2012/0272818 A1 11/2012 Dueck et al.
2012/0291614 A1 11/2012 Koumbis
2013/0180796 A1 7/2013 Dueck et al.
2013/0312592 A1 11/2013 Storrs et al.
2014/0059913 A1 3/2014 Diamond et al.
2014/0076658 A1 3/2014 Smith, II et al.
2014/0224574 A1 * 8/2014 Latka ..... F41A 21/30 181/223
2014/0224575 A1 8/2014 Latka
2014/0237881 A1 * 8/2014 Mack ..... F41A 21/325 42/90
2014/0262605 A1 9/2014 Washburn, III et al.
2014/0318887 A1 10/2014 Latka
2015/0041246 A1 2/2015 Coley
2015/0253099 A1 9/2015 Shults
2015/0276341 A1 * 10/2015 Foster ..... F41A 33/02 434/21
2015/0285575 A1 10/2015 Sclafani
2015/0323276 A1 11/2015 Myers et al.
2015/0338183 A1 11/2015 Salvador
2016/0018178 A1 1/2016 Johansen
2016/0018179 A1 1/2016 Morris et al.
2016/0061551 A1 3/2016 Petersen

(56) References Cited

U.S. PATENT DOCUMENTS

| | | | | |
|---|---|---|---|---|
| 2016/0076844 | A1 | 3/2016 | Miller, III | |
| 2016/0076845 | A1 | 3/2016 | Almazan et al. | |
| 2016/0084602 | A1 | 3/2016 | Smith | |
| 2016/0102935 | A1 | 4/2016 | Young | |
| 2016/0187093 | A1 | 6/2016 | Barrett | |
| 2017/0160034 | A1 | 6/2017 | Parker | |
| 2017/0299314 | A1 | 10/2017 | Palu | |
| 2017/0321984 | A1* | 11/2017 | Palu | F41A 21/34 |
| 2017/0328666 | A1 | 11/2017 | Liskey et al. | |
| 2018/0259283 | A1* | 9/2018 | Pittman | G04B 99/00 |

* cited by examiner

NOISE SUPPRESSOR FOR FIREARM AND BLANK FIRING ADAPTER FOR FIREARM

CROSS REFERENCE TO RELATED APPLICATIONS

This application claims priority to provisional U.S. Patent Application Ser. No. 62/510,868 (the "'868 application"), filed May 25, 2017 by Kurtis A. Palu et al. and titled, "Noise Suppressor for Firearm and Blank Firing Adapter for Firearm", which is hereby incorporated by reference in its entirety for all purposes.

This application may be related to the following applications (collectively, the "Related applications"), each of which is incorporated by reference in its entirety for all purposes: U.S. patent application Ser. No. 15/918,968 (the "'968 application"), filed Mar. 12, 2018 by Kurtis A. Palu et al. and titled, "Bipod for Firearm", which claims the benefit of provisional U.S. Patent Application Ser. No. 62/470,708 (the "'708 application"), filed Mar. 13, 2017 by Kurtis A. Palu et al. and titled, "Bipod for Firearm"; U.S. patent application Ser. No. 15/483,648 (the "'648 application"), filed Apr. 10, 2017 by Kurtis A. Palu and titled, "Noise Suppressor for Firearm", which claims the benefit of provisional U.S. Patent Application No. 62/322,063 (the "'063 application"), filed Apr. 13, 2016 by Kurtis A. Palu and titled, "Noise Suppressor for Firearm"; U.S. patent application Ser. No. 15/404,837 (the "'837 application"), filed Jan. 12, 2017 by Kurtis A. Palu et al. and titled, "Noise Suppressor for Firearm", which claims the benefit of provisional U.S. Patent Application No. 62/278,270 (the "'270 application"), filed Jan. 13, 2016 by Kurtis A. Palu et al. and titled, "Noise Suppressor for Firearm"; U.S. patent application Ser. No. 15/281,323 (the "'323 application"), filed Sep. 30, 2016 by Kurtis Allen Palu and titled "Locking Mechanism for Suppressor Mount", which claims the benefit of provisional U.S. Patent Application No. 62/236,487 (the "'487 application"), filed Oct. 2, 2015 by Kurtis Allen Palu and titled, "Suppressor Mount"; U.S. patent application Ser. No. 14/816,321 (the "'321 application"), filed Aug. 3, 2015 by Kurtis A. Palu et al. and titled, "Noise Suppressor for Firearm"; U.S. patent application Ser. No. 14/987,984 (now U.S. Pat. No. 9,459,065; the "'065 patent"), filed Jan. 5, 2016 by Kurtis A. Palu and titled, "Flash Suppressor for Firearm", which is a divisional application of U.S. patent application Ser. No. 14/465,060 (now U.S. Pat. No. 9,261,319; the "'319 patent") filed Aug. 21, 2014 by Kurtis A. Palu and titled, "Flash Suppressor for Firearm"; U.S. patent application Ser. No. 14/615,826 (now U.S. Pat. No. 9,366,495; the "'495 patent") filed Feb. 6, 2015 by Michael S. Coppinger et al. and titled, "Noise Suppressor for Firearm"; and U.S. patent application Ser. No. 14/640,791 (the "'791 application"), filed Mar. 6, 2015 by Michael S. Coppinger et al. and titled, "Noise Suppressor for Firearm", which claims the benefit of provisional U.S. Patent Application No. 61/949,670 (the "'670 application"), filed Mar. 7, 2014 by Michael Shane Coppinger et al. and titled, "Sound Suppressor with Longitudinal Baffle".

The respective disclosures of these applications/patents (which this document refers to collectively as the "Related applications") are incorporated herein by reference in their entirety for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a firearm noise suppressor designed to utilize a cone baffle design for full automatic firearm usage and to a blank firing adapter that couples with the firearm noise suppressor. More particularly, the novel noise suppressor can be disassembled and is able to withstand usage under full automatic fire mode, while the blank firing adapter can be threaded into the firearm noise suppressor and can stop even live fire rounds.

BACKGROUND

In order to fire a projectile, a firearm utilizes an ignited propellant to create a high-pressure pulse of hot gases behind the projectile to force the projectile down the barrel of the firearm. When the high-pressure gases exit the barrel of the firearm, they generate a loud noise, commonly referred to as a "muzzle blast." Noise suppressors are commonly used with firearms, such as rifles and handguns, to reduce muzzle blast. To reduce muzzle blast, suppressors attach to the end of the firearm barrel and allow the high-pressure gases to expand, and thereby dissipate pressure, before exiting the firearm. By allowing the pressure behind the projectile to dissipate before exiting the firearm, a firearm suppressor can significantly reduce muzzle blast.

For fully automatic firearms, some manufacturers use a monocore baffle design for a noise or firearm suppressor that threads directly to the barrel of the firearm. In some cases, the monocore baffle is pinned and welded to the barrel of the firearm to prevent the monocore baffle from loosening under the vibration and stresses of automatic fire. Monocore baffles, however, do not provide the level of noise suppression performance that separate baffles (e.g., cone baffles or the like) provide. Currently available separate baffle designs for fully automatic firearms use a threaded exit end, but such designs are susceptible to loosening of the threaded exit end under the vibration and stresses of automatic fire, in some instances, resulting in the baffles and the exit end being shot in the direction of fire. Thus, increasing the risks of injury or harm to nearby people and objects.

Further, when using blanks, conventional approaches and designs require replacing the noise or firearm suppressor with a separate, dedicated suppressor designed for blanks. The inventors are unaware of any prior existing blank firing adapter that can be threaded into an exit end of a noise or firearm suppressor and is capable of withstanding live rounds being fired into them. Generally, live rounds being (inadvertently or accidentally) fired into such conventional blank firing adapters would destroy such conventional components, in some cases resulting in parts of such conventional components being shot in the direction of fire as shrapnel or the like. Thus, increasing the risks of injury or harm to nearby people and objects. Although they are supposed to stop a single live round, current military blank firing adapters that can be threaded into the exit end of a noise or firearm suppressor are not capable of doing so.

Accordingly, there is a need for a noise suppressor design that can be disassembled and is able to withstand usage under full automatic fire mode, as well as a blank firing adapter that can be coupled to the noise suppressor (and in some cases, can withstand live rounds being fired into it).

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION

Overview

Figure 1:
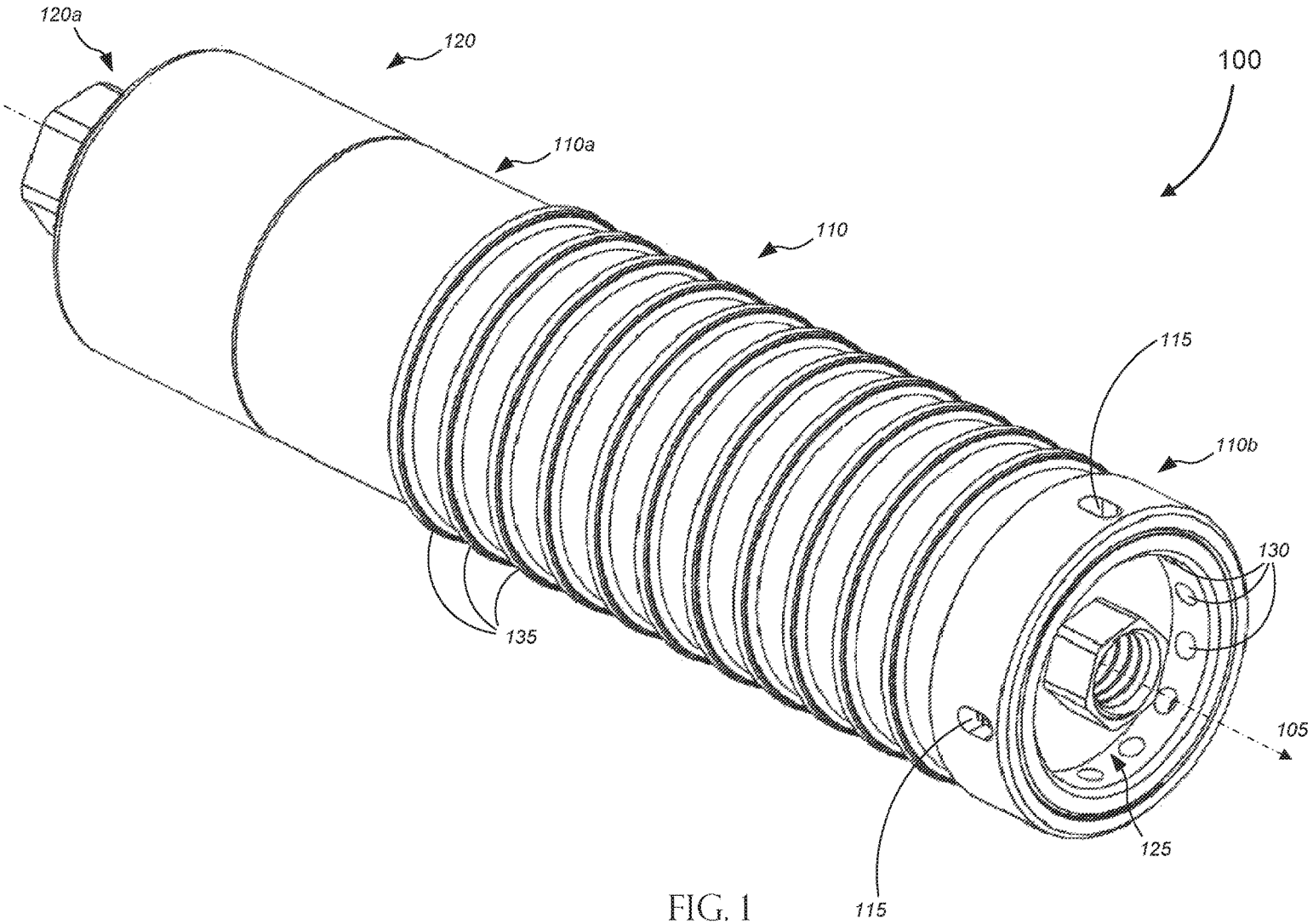
FIG. 1 shows a top perspective view of a noise suppressor for a firearm that is an embodiment of the present invention.

Various embodiments provide for a noise suppressor for a firearm that can be disassembled and is able to withstand usage under full automatic fire mode and/or provide for a blank firing adapter that can be coupled to the noise suppressor (and in some cases, can withstand live rounds being fired into it).

In various embodiments, a noise suppressor for a firearm might include, without limitation, a central axis, an outer tube, a blast chamber, a plurality of baffles, a proximal end cap, a distal end cap, and at least one pin, and/or the like. The outer tube might include a proximal end and a distal end, the outer tube further including a plurality of first holes spaced apart from each other along a circumference of the distal end. The plurality of baffles might be disposed along the central axis, each of the plurality of baffles including a bore aligned along the central axis when the noise suppressor is assembled. The distal end cap might include a plurality of second holes spaced apart from each other along a circumference of the distal end cap. The distal end cap couples to the distal end of the outer tube via threading on a circumferential surface on one of the distal end cap or the distal end and via complementary threading on a circumferential surface on the other of the distal end cap or the distal end. Each pin of the at least one pin might pass through at least one first hole of the plurality of first holes and at least one second hole of the plurality of second holes, each pin being releasably affixed to one or more of the at least one first hole or the at least one second hole, when the noise suppressor is assembled.

The use of both a primary retention system (i.e., threading for the distal end cap and the outer tube) and a second retention systems (i.e., the at least one pin being releasably affixed to one or more of the at least one first hole or the at least one second hole) allows for a cone baffle assembly in a noise suppressor that can be disassembled and is capable of withstanding full automatic fire.

In some embodiments, a blank firing adapter ("BFA") for a firearm might include, but is not limited to, an outer end cap, a rod, an inner bore hole, and at least one vent hole. The outer end cap couples to a distal end cap of a noise suppressor, when the blank firing adapter is coupled to the noise suppressor. The noise suppressor further comprises a plurality of baffles that are disposed along a central axis when the noise suppressor is assembled. The rod comprises a distal end and a proximal end, the distal end being affixed to the outer end cap, and the rod being disposed through a bore of each of the plurality of baffles when the blank firing adapter is coupled to the noise suppressor. The inner bore hole is disposed within the proximal end of the rod and is disposed longitudinally along an axis of the rod. At least a portion of the inner bore hole has an inner diameter that is less than an outer diameter of a bullet that is fired by a firearm to which the noise suppressor is removably affixed when the blank firing adapter is coupled to the noise suppressor and when the noise suppressor is coupled to the firearm. The inner diameter might be less than an outer diameter of the rod. The at least one vent hole is disposed through a side wall of the inner bore hole.

Unlike conventional blank firing adapters or conventional suppressors for blanks, the BFA as described herein is designed to be threaded into a distal end of the noise suppressor. Further, the BFA is capable of withstanding (and stopping) live fire rounds, even live rounds that are fired in full automatic mode, without appreciable or significant damage to the components, as the BFA is designed to safely dampen and/or redirect the energy of the live fire rounds.

These and other features of the noise suppressor for firearm and/or the blank firing adapter are described in detail below with respect to the figures, which depict non-limiting embodiments of the invention.

The following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In an aspect, a noise suppressor for a firearm might comprise a central axis, an outer tube, a blast chamber, a plurality of baffles, a proximal end cap, a distal end cap, and at least one pin. The outer tube might comprise a proximal end and a distal end, the outer tube further comprising a plurality of first holes spaced apart from each other along a circumference of the distal end. The plurality of baffles might be disposed along the central axis, each of the plurality of baffles comprising a bore aligned along the central axis when the noise suppressor is assembled. The distal end cap might comprise a plurality of second holes spaced apart from each other along a circumference of the distal end cap. The distal end cap couples to the distal end of the outer tube via threading on a circumferential surface on one of the distal end cap or the distal end and via complementary threading on a circumferential surface on the other of the distal end cap or the distal end. Each pin of the at least one pin might pass through at least one first hole of the plurality of first holes and at least one second hole of the plurality of second holes, each pin being releasably affixed to one or more of the at least one first hole or the at least one second hole, when the noise suppressor is assembled.

According to some embodiments, each of the at least one pin might comprise one of a slotted roll pin or a coiled roll pin, or the like.

In another aspect, a noise suppressor for a firearm might comprise a central axis, an outer tube, a blast chamber, a plurality of baffles, a proximal end cap, a distal end cap, and at least one pin. The outer tube might comprise a proximal end and a distal end, the outer tube further comprising a plurality of first holes spaced apart from each other along a circumference of the distal end. The plurality of baffles might be disposed along the central axis. The distal end cap might comprise a plurality of second holes spaced apart from each other along a circumference of the distal end cap. Each pin of the at least one pin might pass through at least one first hole of the plurality of first holes and at least one second hole of the plurality of second holes, each pin being releasably affixed to one or more of the at least one first hole or the at least one second hole, when the noise suppressor is assembled.

In some embodiments, each of the at least one pin might comprise one of a slotted roll pin or a coiled roll pin, or the like. Merely by way of example, in some instances, the plurality of first holes might comprise a first number of holes that are spaced equidistant from each other along the circumference of the distal end of the outer tube, while the plurality of second holes might comprise a second number of holes that are spaced equidistant from each other along the circumference of the distal end cap, the second number of holes being different from the first number of holes.

According to some embodiments, the distal end cap might couple to an inner circumferential surface of the distal end of the outer tube via threading on an outer circumferential surface of the distal end cap and complementary threading on the inner circumferential surface of the distal end of the outer tube. In some cases, the second number of holes might be greater than the first number of holes. In some instances, each of the plurality of second holes might have a circular shape, while each of the plurality of first holes might have an oval shape. In some embodiments, each of the at least one pin might have a first end and threading on the first end, where each of the plurality of second holes might comprise complementary threading for coupling with the threading on the first end of one of the at least one pin.

Alternatively, the distal end cap might couple to an outer circumferential surface of the distal end of the outer tube via threading on an inner circumferential surface of the distal end cap and complementary threading on the outer circumferential surface of the distal end of the outer tube. In some instances, the first number of holes might be greater than the second number of holes. In some cases, each of the plurality of first holes might have a circular shape, while each of the plurality of second holes might have an oval shape. According to some embodiments, each of the at least one pin might have a first end and threading on the first end, where each of the plurality of first holes might comprise complementary threading for coupling with the threading on the first end of one of the at least one pin.

In yet another aspect, a blank firing adapter for a firearm might comprise an outer end cap, a rod, an inner bore hole, and at least one vent hole. The outer end cap couples to a distal end cap of a noise suppressor, when the blank firing adapter is coupled to the noise suppressor. The noise suppressor further comprises a plurality of baffles that are disposed along a central axis when the noise suppressor is assembled. The rod comprises a distal end and a proximal end, the distal end being affixed to the outer end cap, and the rod being disposed through a bore of each of the plurality of baffles when the blank firing adapter is coupled to the noise suppressor. The inner bore hole is disposed within the proximal end of the rod and is disposed longitudinally along an axis of the rod. At least a portion of the inner bore hole has an inner diameter that is less than an outer diameter of a bullet that is fired by a firearm to which the noise suppressor is removably affixed when the blank firing adapter is coupled to the noise suppressor and when the noise suppressor is coupled to the firearm. The inner diameter might be less than an outer diameter of the rod. The at least one vent hole is disposed through a side wall of the inner bore hole.

According to some embodiments, the distal end cap might comprise a bore hole that is aligned along the central axis when the noise suppressor is assembled. The distal end cap might further comprise threading on an inner circumference of the bore hole. The blank firing adapter might further comprise complementary threading on at least a portion of the distal end of the rod for coupling with the threading on the inner circumference of the bore hole of the distal end cap. In some cases, the complementary threading on the at least a portion of the distal end of the rod might comprise a slot that runs transverse to the threading and parallel to the axis of the rod, where the slot defines a vent hole through the outer end cap.

In some embodiments, the noise suppressor might further comprise an outer tube and at least one first pin. The outer tube might comprise a proximal end and a distal end, the outer tube further comprising a plurality of first holes spaced apart from each other along a circumference of the distal end. The distal end cap might further comprise a plurality of second holes spaced apart from each other along a circumference of the distal end cap. Each first pin of the at least one first pin might pass through at least one first hole of the plurality of first holes and at least one second hole of the plurality of second holes, each first pin being releasably affixed to one or more of the at least one first hole or the at least one second hole, when the noise suppressor is assembled.

In such embodiments, the blank firing adapter might further comprise at least one second pin. The outer end cap might comprise a cylindrical side wall and a plurality of third holes. The cylindrical side wall might surround at least a portion of the distal end of the outer tube and at least a portion of the distal end cap. The plurality of third holes might be spaced apart from each other along a circumference of the cylindrical side wall. In some instances, the at least one second pin might releasably affix to the one or more of the at least one first hole or the at least one second hole through at least one third hole of the plurality of third holes, when the noise suppressor is assembled and when the blank firing adapter is coupled to the noise suppressor.

In some cases, one or more of the at least one first pin and one or more of the at least one second pin might be the same at least one pin. According to some embodiments, each of the at least one first pin and each of the at least one second pin might each comprise one of a slotted roll pin or a coiled roll pin, and/or the like. In some embodiments, each of the plurality of third holes might have a shape comprising one of circular or oval, or the like.

In still another aspect, a noise suppressor system for a firearm might comprise a noise suppressor for a firearm and a blank firing adapter. The noise suppressor for a firearm might comprise a central axis, an outer tube, a blast chamber, a plurality of baffles, a proximal end cap, a distal end cap, and at least one first pin. The outer tube might comprise a proximal end and a distal end, the outer tube further comprising a plurality of first holes spaced apart from each other along a circumference of the distal end. The plurality of baffles might be disposed along the central axis, each of the plurality of baffles comprising a bore aligned along the central axis when the noise suppressor is assembled. The distal end cap might comprise a plurality of second holes spaced apart from each other along a circumference of the distal end cap. Each first pin of the at least one first pin might pass through at least one first hole of the plurality of first holes and at least one second hole of the plurality of second holes, each first pin being releasably affixed to one or more of the at least one first hole or the at least one second hole, when the noise suppressor is assembled.

The blank firing adapter might comprise an outer end cap, a rod, an inner bore hole, and at least one vent hole. The outer end cap couples to a distal end cap of a noise suppressor, when the blank firing adapter is coupled to the noise suppressor. The rod comprises a distal end and a proximal end, the distal end being affixed to the outer end cap, and the rod being disposed through the bore of each of the plurality of baffles when the blank firing adapter is coupled to the noise suppressor. The inner bore hole is disposed within the proximal end of the rod and is disposed longitudinally along an axis of the rod. At least a portion of the inner bore hole has an inner diameter that is less than an outer diameter of a bullet that is fired by a firearm to which the noise suppressor is removably affixed when the blank firing adapter is coupled to the noise suppressor and when the noise suppressor is coupled to the firearm. The inner diameter might be less than an outer diameter of the rod. The at least one vent hole is disposed through a side wall of the inner bore hole.

In some embodiments, the distal end cap might comprise a bore hole that is aligned along the central axis when the noise suppressor is assembled, the distal end cap further comprising threading on an inner circumference of the bore hole. The blank firing adapter might further comprise complementary threading on at least a portion of the distal end of the rod for coupling with the threading on the inner circumference of the bore hole of the distal end cap. In some cases, the complementary threading on the at least a portion of the distal end of the rod might comprise a slot that runs transverse to the threading and parallel to the axis of the rod, where the slot defines a vent hole through the outer end cap.

According to some embodiments, the blank firing adapter might further comprise at least one second pin, and the outer end cap might comprise a cylindrical side wall and a plurality of third holes. The cylindrical side wall might surround at least a portion of the distal end of the outer tube and at least a portion of the distal end cap. The plurality of third holes might be spaced apart from each other along a circumference of the cylindrical side wall. The at least one second pin might releasably affix to the one or more of the at least one first hole or the at least one second hole through at least one third hole of the plurality of third holes, when the noise suppressor is assembled and when the blank firing adapter is coupled to the noise suppressor.

Merely by way of example, in some embodiments, one or more of the at least one first pin and one or more of the at least one second pin might be the same at least one pin. In some cases, each of the at least one first pin and each of the at least one second pin might each comprise one of a slotted roll pin or a coiled roll pin, or the like. In some instances, each of the plurality of third holes has shape comprising one of circular or oval, or the like.

Various modifications and additions can be made to the embodiments discussed without departing from the scope of the invention. For example, while the embodiments described above refer to particular features, the scope of this invention also includes embodiments having different combination of features and embodiments that do not include all of the above described features.

Specific Exemplary Embodiments

Figure 2:
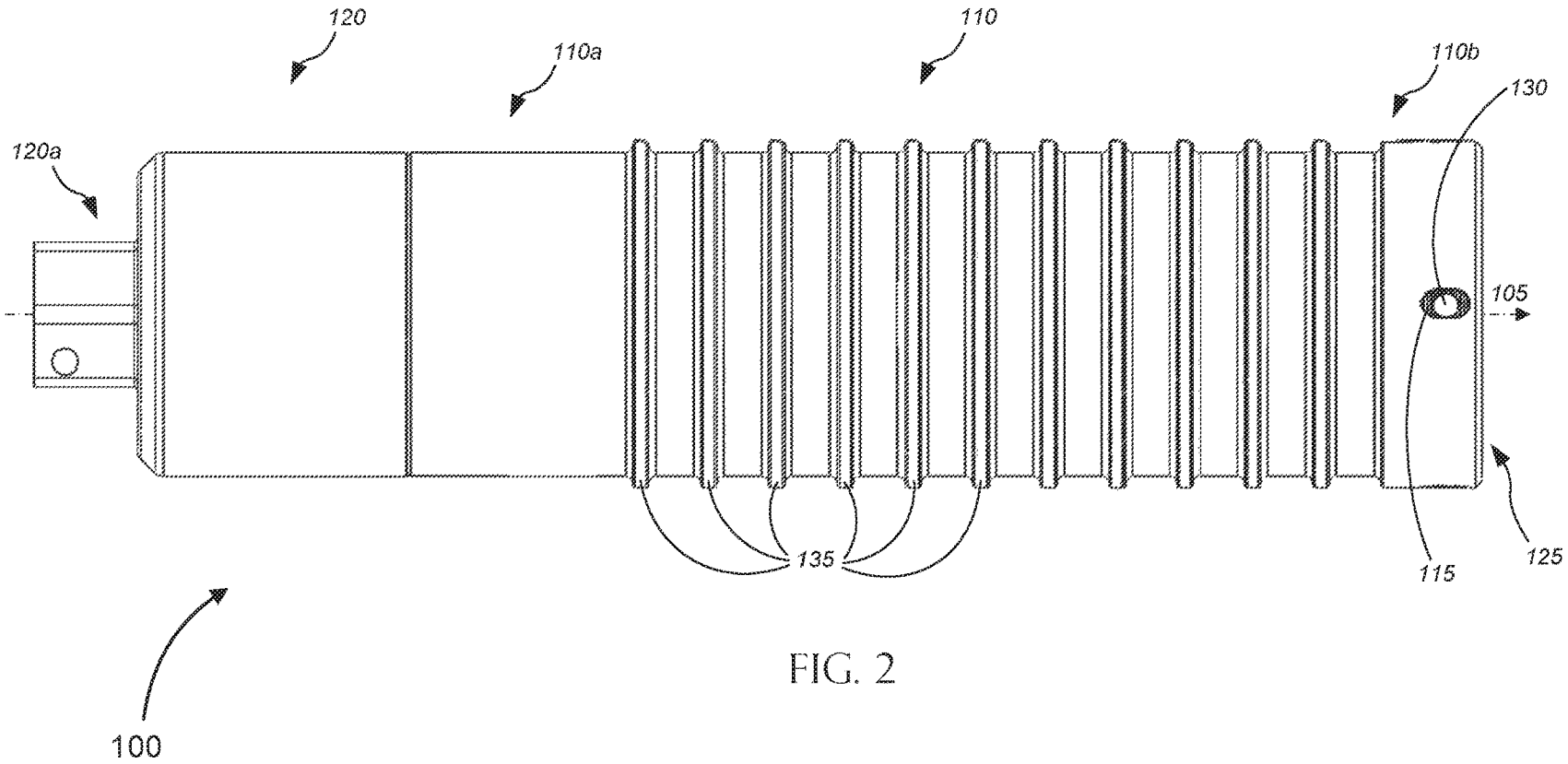
FIG. 2 shows a side elevation view of the noise suppressor of FIG. 1.
Figure 3:
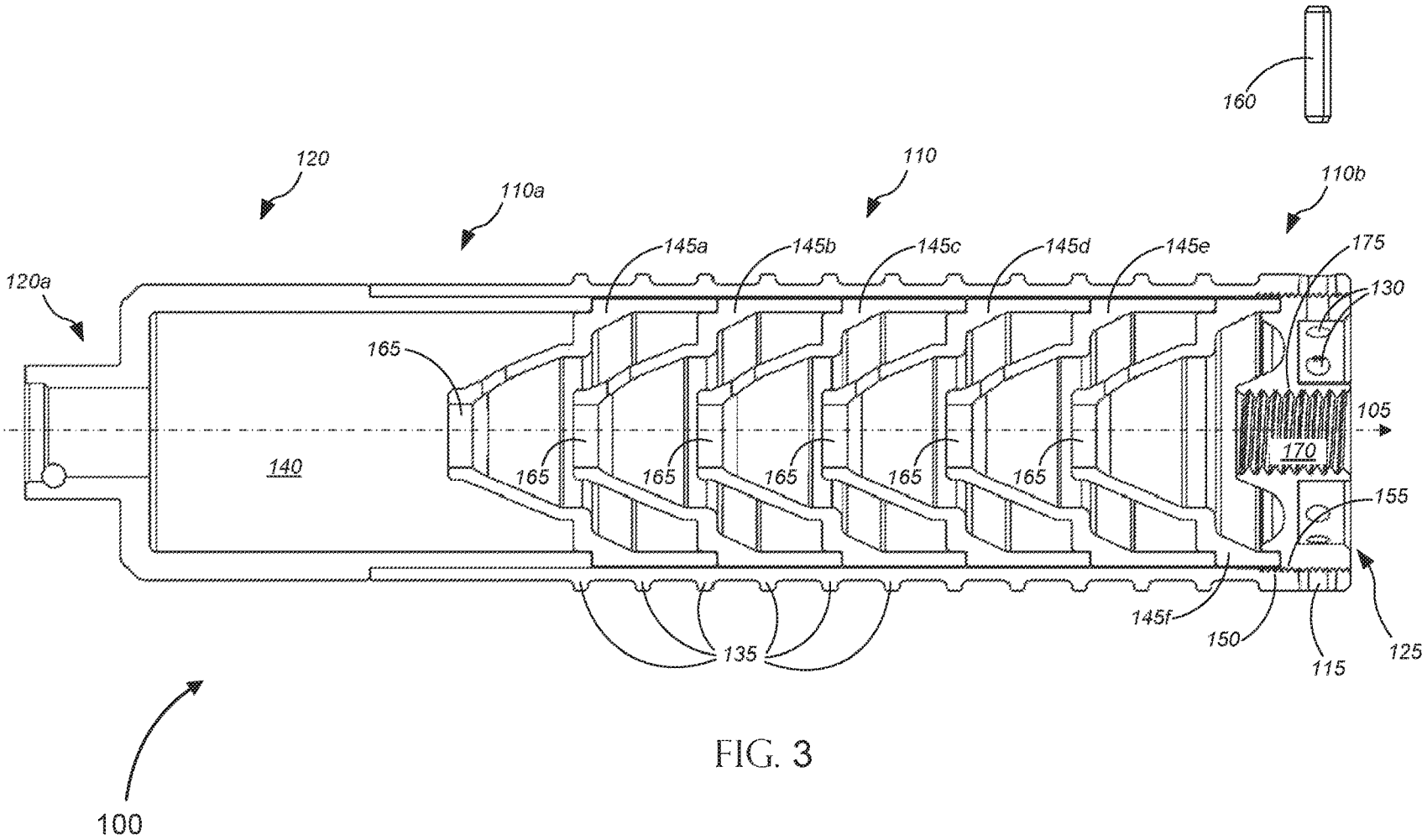
FIG. 3 shows a partial cutout view of the noise suppressor of FIG. 2.
Figure 5:
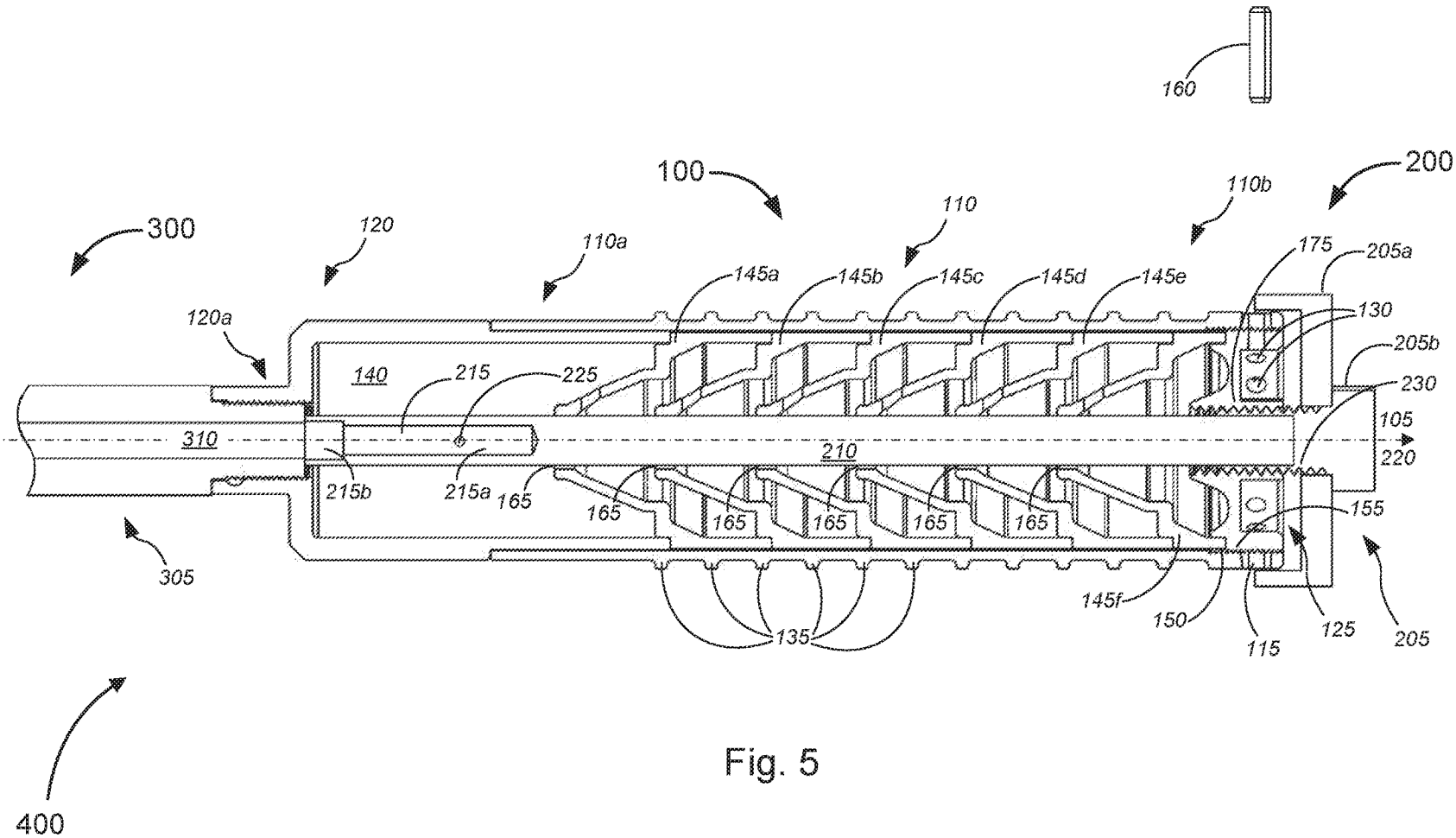
FIG. 5 shows a partial cutout view of a noise suppressor system that includes the noise suppressor of FIG. 2, the blank firing adapter of FIG. 4, and a portion of a barrel of a firearm, in accordance with various embodiments.
Figure 6:
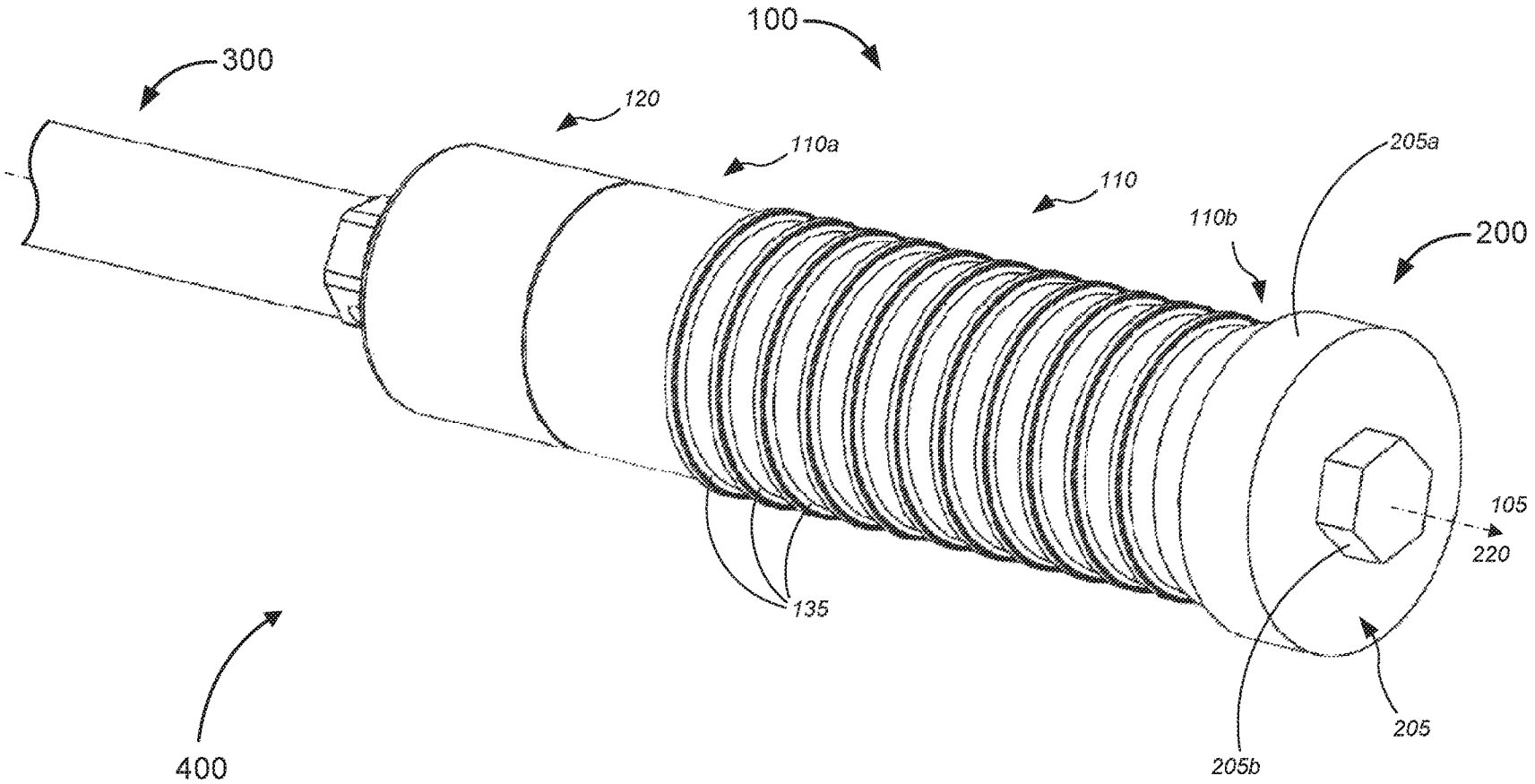
FIG. 6 shows a top perspective view of the noise suppressor system of FIG. 5.

We now turn to the embodiments as illustrated by the drawings. FIGS. 1-6 illustrate some of the features of a noise suppressor that can be disassembled and is able to withstand usage under full automatic fire mode and/or provide for a blank firing adapter that can be coupled to the noise suppressor (and in some cases, can withstand live rounds being fired into it), as referred to above. In particular, FIGS. 1-3 depict such a noise suppressor, while FIG. 4 depicts such a blank firing adapter, and FIGS. 5 and 6 depict a noise suppressor system in which the blank firing adapter is removably coupled to the noise suppressor, which itself is removably coupled to the barrel of a firearm. The apparatuses or systems illustrated by FIGS. 1-6, in some cases, may refer to examples of different embodiments that include various components, which can be considered alternatives or which can be used in conjunction with one another in the various embodiments. The description of the illustrated apparatuses or systems shown in FIGS. 1-6 is provided for purposes of illustration and should not be considered to limit the scope of the different embodiments.

As used in this application, the term "proximal" is used to refer to the end of the component or element closest to a barrel of a firearm and the term "distal" is used to refer to the end of the component or element farthest from the barrel of the firearm.

With reference to the figures, FIG. 1 shows a top perspective view of a noise suppressor 100 for a firearm that is an embodiment of the present invention. In the non-limiting example of FIG. 1, noise suppressor 100 might comprise a central axis 105, an outer tube 110, a plurality of first holes 115, a proximal end cap 120, a distal end cap 125, and a plurality of second holes 130. The outer tube 110, the proximal end cap 120, and the distal end cap 125 are disposed along (or otherwise aligned with) the central axis 105. In some embodiments, the outer tube 110 might include, without limitation, a proximal end 110*a*, a distal end 110*b*, and a plurality of grips 135 (which, in the non-limiting example of FIG. 1, are depicted as a plurality of transverse ribs, or the like). The plurality of grips 135, in some instances, provide additional surface area to aid in cooling the suppressor. In some instances, the proximal end cap 120 might comprise a connector 120*a* that removable couples with a barrel of a firearm (as shown, e.g., in FIGS. 5 and 6, or the like).

Merely by way of example, the plurality of first holes 115 may be spaced apart from each other along a circumference of the distal end 110*b* of the outer tube. In some cases, the plurality of first holes 115 comprises a first number of holes that might be spaced apart (in some instances, spaced equidistant) from each other along the circumference of the distal end 110*b* of the outer tube 110. Similarly, the plurality of second holes 130 might be spaced apart (in some instances, spaced equidistant) from each other along a circumference of the distal end cap 125. According to some embodiments, the second number of holes (i.e., the number of the second holes 130) might be different from the first number of holes (i.e., the number of the first holes 115). For example, in some embodiments, there might be four outer holes (in this case, four first holes through the distal end 110*b* of the outer tube 110) and thirteen inner holes (in this case, thirteen second holes through the distal end cap 125). Although specific numbers are used herein, any suitable number of first and/or second holes may be used as desired and/or as appropriate.

In some embodiments, the plurality of first holes 115 and the plurality of second holes 130 might have the same shape (e.g., circular shape) [not shown]. Alternatively, the plurality of first holes 115 and the plurality of second holes 130 might have different shapes. For example, the inner one of the distal end 110*b* or the distal end cap 125 might have holes each having a circular shape, while the outer one of the distal end 110*b* or the distal end cap 125 might have holes each having an oval shape. The oval-shaped outer holes have a shorter diameter in the transverse direction (i.e., direction perpendicular to the central axis 105) and a longer diameter in the longitudinal direction (i.e., direction parallel to the central axis 105), with the shorter diameter matching the diameter of the circular inner holes. In this manner, insertion of the at least one pin 160 (of FIG. 3) into at least one set of oval-shaped outer hole and circular inner hole would prevent rotation of the distal end cap 125 relative to the outer tube 110. The longer diameter of the oval shape facilitates machine tolerances in the suppressor.

FIG. 2 shows a side elevation view of the noise suppressor 100 of FIG. 1. As shown in FIG. 2, the noise suppressor 100 of FIG. 1 is assembled such that at least one first hole 115 of the plurality of first holes 115 is aligned with at least one second hole 130 of the plurality of second holes 130. To accomplish this, the distal end cap 125 is rotated with respect to the distal end 110*b* of the outer tube 110 (in some cases, such as shown in the non-limiting example of FIG. 3, the distal end cap 125 has threading on a circumferential surface thereof that couples with complementary threading on a circumferential surface of the distal end 110*b*, or the like) until the at least one first hole 115 aligns with the at least one second hole 130. In some instances, at least one of the outer tube 110 and/or the distal end cap 125 is made of a material or is otherwise designed to possess sufficient elastic deformation characteristics to enable one of the outer tube 110 or the distal end cap 125 to thread into the other of the outer tube 110 or the distal end cap 125, and to be further tightened by rotational movement to align the at least one first hole 115 with the at least one second hole 130.

FIG. 3 shows a partial cutout view of the noise suppressor 100 of FIG. 2. As shown in the non-limiting embodiment of FIG. 3, noise suppressor 100 might comprise the central axis 105, the outer tube 110, the proximal end 110*a* and the distal end 110*b* of the outer tube 110, the plurality of first holes 115, the proximal end cap 120 and the connector 120*a*, the distal end cap 125, the plurality of second holes 130, and the plurality of ribs or grips 135, as shown and discussed above with respect to FIGS. 1 and/or 2. Noise suppressor 100 might further comprise blast chamber 140 and a plurality of baffles 145. The plurality of baffles 145 might include, but is not limited to, first through sixth baffles 145*a*-145*f*, or the like. Although six baffles 145 are shown in FIG. 3, the various embodiments are not so limited, and the noise suppressor 100 may comprise any suitable number of baffles 145. In some cases, each of one or more baffles 145 might comprise one or more notches that serve to further dissipate the high pressure gases, as described in detail in the '837 application (which has already been incorporated herein by reference in its entirety for all purposes).

According to some embodiments, the distal end cap 125 has threading 155 on a circumferential surface thereof that couples with complementary threading 150 on a circumferential surface of the distal end 110*b*, or the like. Although FIG. 3 shows the circumferential surface of the distal end cap 125 as being the outer circumferential surface and the circumferential surface of the distal end 110*b* of the outer tube 110 as being the inner circumferential surface, with the diameter of the distal end cap 125 being smaller than the diameter of the distal end 110*b* of the outer tube 110 (i.e., with the distal end cap 125 fitting within the distal end 110*b*), the various embodiments are not so limited. For instance, in an alternative set of embodiments (not shown), the circumferential surface of the distal end cap 125 might be the inner circumferential surface while the circumferential surface of the distal end 110*b* of the outer tube 110 might be the outer circumferential surface, with the diameter of the distal end cap 125 being greater than the diameter of the distal end 110*b* of the outer tube 110 (i.e., with the distal end 110*b* fitting within the distal end cap 125). In any case, the one of the distal end 110*b* or the distal end cap 125 that surrounds the other might have a smaller number of holes than the inner one of the distal end 110*b* or the distal end cap 125. For example, as shown in FIG. 3, the distal end cap 125 (which fits within the distal end 110*b*) has more holes than the distal end 110*b*. In some cases, there might be four holes through the distal end 110*b*, while there might be thirteen holes through the distal end cap 125. Other embodiments might have different numbers of holes other than four holes for the outer one of the distal end 110*b* or the distal end cap 125, and/or might have different numbers of holes other than thirteen holes for the inner one of the distal end 110*b* or the distal end cap 125.

As discussed above, the distal end cap 125 is rotated with respect to the distal end 110*b* of the outer tube 110 until the at least one first hole 115 aligns with the at least one second hole 130. In some instances, at least one of the outer tube 110 and/or the distal end cap 125 is made of a material or is otherwise designed to possess sufficient elastic deformation characteristics to enable one of the outer tube 110 or the distal end cap 125 to thread into the other of the outer tube 110 or the distal end cap 125, and to be further tightened by rotational movement to align the at least one first hole 115 with the at least one second hole 130. With the at least one first hole 115 aligned with the at least one second hole 130, each of at least one pin 160 may be inserted into (or passed through) each set of the at least one first hole 115 and the at least one second hole 130. The at least one pin 160 might include, but is not limited to, one of a slotted roll pin (also referred to as "a slotted spring pin," "a slotted tension pin," "a C-pin," or the like) or a coiled roll pin (also referred to as "a coiled spring pin," "a coiled tension pin," "a spiral pin," or the like), or the like. Roll pins are mechanical fasteners that utilize spring action to exert a force against a hole wall to retain itself within the hole, despite shearing forces applied to the component(s) with the hole; to do so, the roll pin is selected to have a (resting) body diameter that is larger than the diameter of the hole. A chamfer on one or both ends of the roll pin facilitate insertion of the roll pin into the hole. Alternatively, the at least one pin 160 might each comprise a pin or rod having threading on at least an end portion thereof (in some cases, embodied as set screws or the like). When each pin or rod is inserted through each set of the at least one first hole 115 and the at least one second hole 130, said pin or rod might couple to at least the inner one of the distal end 110*b* or the distal end cap 125, which has complementary threading to receive and secure the pin or rod into place.

In either set of embodiments (i.e., roll pin embodiments and threaded pin/set screw embodiments), the use of double retention system significantly reduces (and in some cases, substantially eliminates or obviates) the risk that the end cap might loosen from the outer tube during full automatic fire conditions, thereby resulting in the end cap and the baffles being shot along the same direction as the exiting bullets. Here, the double retention system might include a primary retention system and a secondary retention system, with the primary retention system being the threading 150 on a circumferential surface of the distal end 110*b* of the outer tube 110 with complementary threading 155 on a circumferential surface of the distal end cap 125, and with the secondary retention system being the at least one pin being passed or inserted through the at least one first hole and the at least one second hole.

Further, as shown in FIG. 3, each of the plurality of baffles 145*a*-145*f* might include a bore hole 165 through which a bullet might pass when the firearm (to which the noise suppressor may be removably affixed) discharges it during operation of the firearm. Similarly, the distal end cap 125 might have a bore hole 170. In some embodiments, bore hole 170 might comprise threading 175 for coupling with complementary threading 230 of the blank firing adapter 200, as shown in FIG. 5.

Figure 4A:
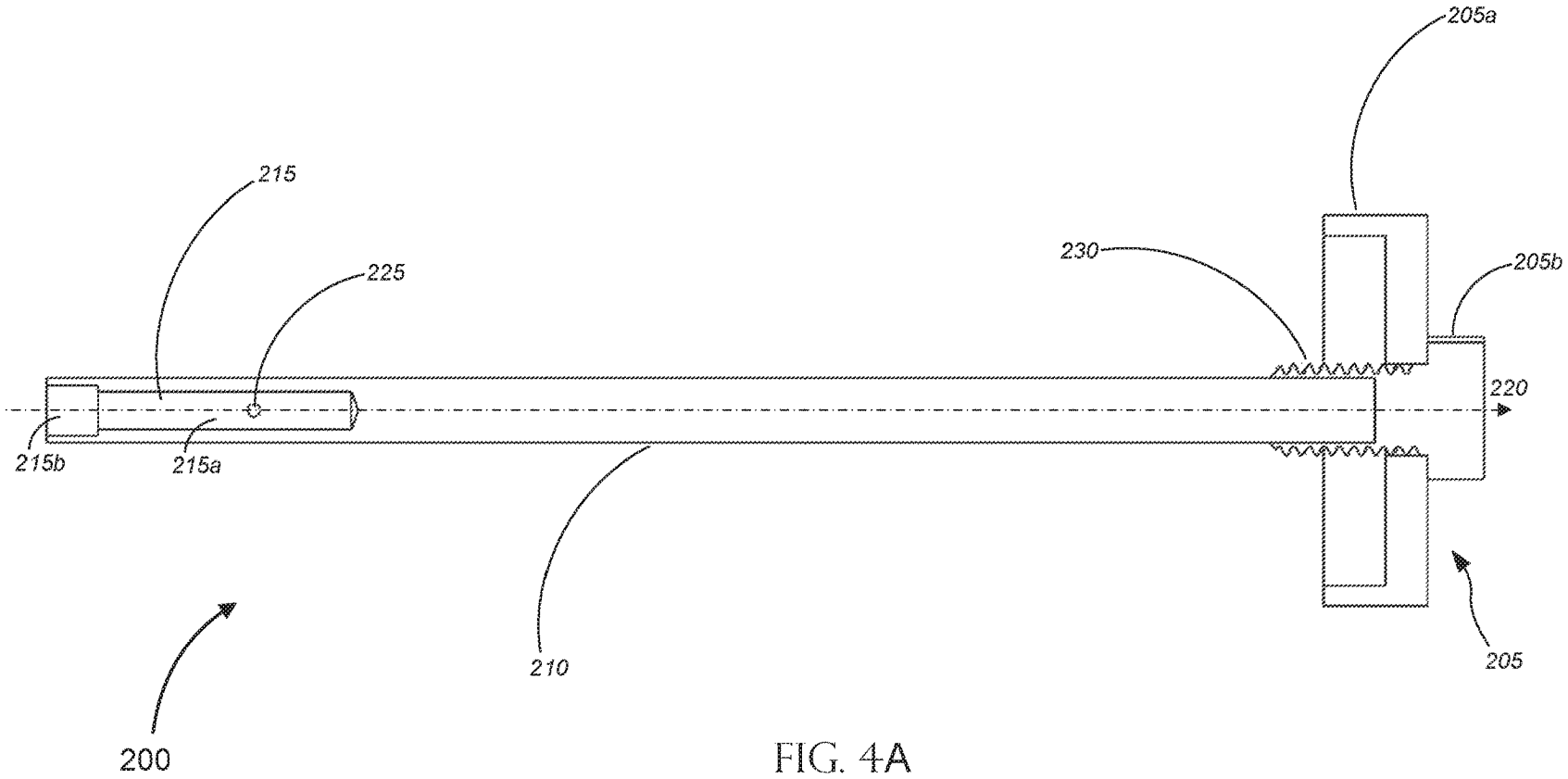
FIG. 4A shows a partial cutout view of a blank firing adapter for use with a noise suppressor for a firearm, in accordance with various embodiments.
Figure 4B:
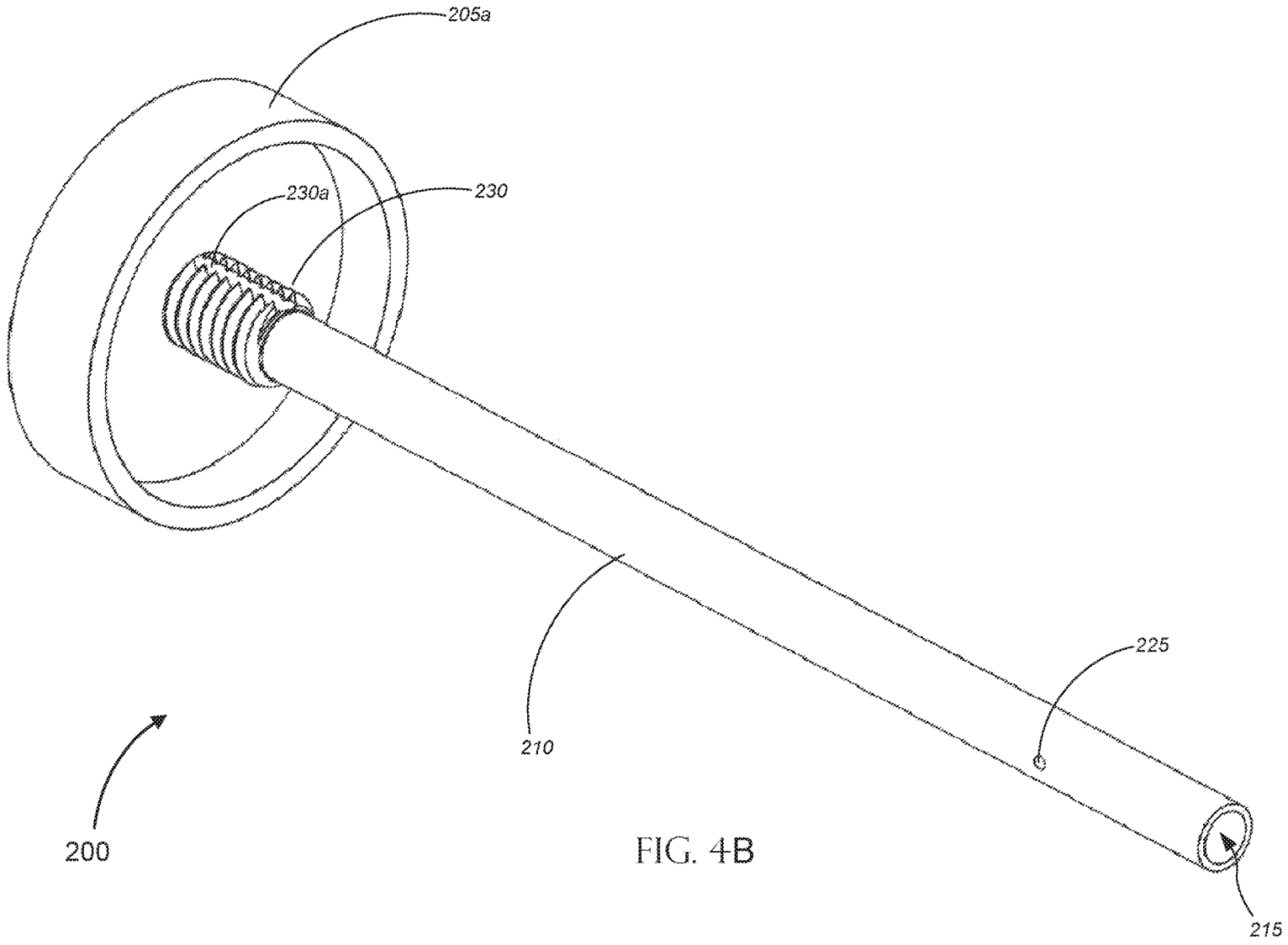
FIG. 4B shows a top perspective view of the blank firing adaptor of FIG. 4A, in accordance with various embodiments.

FIG. 4A shows a partial cutout view of a blank firing adapter 200 for use in a noise suppressor 100 for a firearm, in accordance with various embodiments. FIG. 4B shows a top perspective view of the blank firing adaptor 200 of FIG. 4A, in accordance with various embodiments. In the non-limiting example of FIGS. 4A and 4B (collectively, "FIG. 4"), blank firing adapter ("BFA") 200 might comprise an outer end cap 205 and a rod 210. The rod 210 comprises a distal end and a proximal end, the distal end being affixed to the outer end cap 205. The outer end cap 205, in some embodiments, might comprise a side wall 205*a* (which in some cases may be cylindrical) and a head portion 205*b*.

An inner bore hole 215 might be disposed within the proximal end of the rod 210 and might be disposed longitudinally along an axis 220 of the rod 210. At least a portion 215*a* of the inner bore hole 215 might have a diameter that is less than an outer diameter of a bullet that is fired by a firearm to which the noise suppressor is removably affixed when the blank firing adapter is coupled to the noise suppressor and when the noise suppressor is coupled to the firearm. In some embodiments, at least a portion 215*b* of the inner bore hole 215 might have a diameter that is greater than or equal to the outer diameter of the bullet. In some instances, the inner diameter is less than an outer diameter of the rod 215. The BFA 200 might further comprise at least one vent hole 225 that is disposed through a side wall of the inner bore hole 215.

As shown in FIG. 4B, the complementary threading 230 of the blank firing adapter comprises a groove or slot 230*a* that runs transverse to the threading 230 and parallel to the axis 220 of the rod 210, where the slot 230*a* defines a vent hole through the outer end cap 205. The slot 230*a* serves two functions. First, the slot 230*a* cleans out any carbon in the threads as it is screwed or threaded in so that any carbon in the threading 175 of the distal end 125 does not prevent the BFA 200 from being attached. Second, the slot 230*a* allows the gas that is vented into the noise suppressor 100 from the vent port 225 in the BFA 200 to escape to the atmosphere—i.e., through the vent hole (defined by slot 230*a*) through the outer end cap 205. If there is no slot (or other external venting), the pressure would build up in the suppressor 100, eventually causing the firearm to malfunction.

FIG. 5 shows a partial cutout view of a noise suppressor system 400 that includes the noise suppressor 100 of FIG. 2, the blank firing adapter 200 of FIG. 4, and a portion of a barrel 305 of a firearm 300, in accordance with various embodiments. As shown in a non-limiting embodiment of FIG. 5, noise suppressor 100 might comprise a central axis 105, an outer tube 110, a proximal end 110*a* and a distal end 110*b* of an outer tube 110, a plurality of first holes 115, a proximal end cap 120 and a connector 120*a*, a distal end cap 125, a plurality of second holes 130, and a plurality of ribs or grips 135, a blast chamber 140, and a plurality of baffles 145. A plurality of baffles 145 might include, but is not limited to, first through sixth baffles 145*a*-145*f*, or a like. Although six baffles 145 are shown in FIG. 5, the various embodiments are not so limited, and a noise suppressor 100 may comprise any suitable number of baffles 145. Noise suppressor 100 further comprises threading 150 on a circumferential surface of the distal end 110*b*, threading 155 on a circumferential surface of the distal end cap 125, at least one pin 160, a bore hole 165 in each of the baffles 145, a bore hole 170 in the distal end cap 125 (which is as shown in FIG. 3, but covered by rod 210 of the BFA 200 in FIG. 5), and threading 175 on the inner surface of the bore hole 170 in the distal end cap 125.

The blank firing adapter ("BFA") 200, as shown in the non-limiting example of FIG. 5, might comprise an outer end cap 205 and a rod 210. The rod 210 comprises a distal end and a proximal end, the distal end being affixed to the outer end cap 205. The outer end cap 205, in some embodiments, might comprise a side wall 205*a* and a head portion 205*b*. In some cases, the side wall 205*a* might have a cylindrical shape, or the line.

An inner bore hole 215 might be disposed within the proximal end of the rod 210 and might be disposed longitudinally along an axis 220 of the rod 210. At least a portion 215*a* of the inner bore hole 215 might have a diameter that is less than an outer diameter of a bullet that is fired by a firearm 300 to which the noise suppressor 100 is removably affixed when the blank firing adapter 200 is coupled to the noise suppressor 100 and when the noise suppressor 100 is coupled to the barrel 305 of the firearm 300. In some embodiments, at least a portion 215*b* of the inner bore hole 215 might have a diameter that is greater than or equal to the outer diameter of the bullet. In some instances, the inner diameter is less than an outer diameter of the rod 215. The BFA 200 might further comprise at least one vent hole 225 that is disposed through a side wall of the inner bore hole 215. As shown in FIG. 5, for example, the inner diameter of the portion 215*a* of the inner bore hole 215 is less than the inner diameter of the bore 310 in barrel 305, while the inner diameter of the portion 215*b* of the inner bore hole 215 is greater than the inner diameter of the bore 310 in barrel 305.

When the BFA 200 is coupled with the noise suppressor 100, as shown in FIG. 5, the rod 210 is inserted through the bore hole 170 in the distal end cap 125 and through the bore holes 165 of the plurality of baffles 145, such that the axis 220 and the central axis 105 align (or become co-axial with each other). To secure the BFA 200 in place, the threading 230 of the BFA 200 threads into the threading 175 of the distal end cap 125.

For further securing the BFA 200 to the noise suppressor 100, the cylindrical side wall 205*a*, according to some embodiments, might surround at least a portion of the distal end 110*b* of the outer tube 110 and at least a portion of the distal end cap 125. Merely by way of example, in some embodiments, the outer end cap 205 might further comprise a plurality of third holes (not shown) that are spaced apart from each other along a circumference of the (cylindrical) side wall 205*a*. At least one third hole of the plurality of third holes may be aligned with one or more of the at least one first hole 115 and/or the at least one second hole 130 in a similar manner as described above with respect to FIG. 3 above and the insertion of the at least one pin 160 into each set of the at least one first hole 115 and the at least one second hole 130 that are aligned when one of the distal end 110*b* or the distal end cap 125 is threaded into the other of the distal end 110*b* or the distal end cap 125.

BFA 200 might further comprise at least one second pin (not shown), which may be similar to the at least one pin 160. In other words, the at least one second pin might include, but is not limited to, one of a slotted roll pin (also referred to as "a slotted spring pin," "a slotted tension pin," "a C-pin," or the like) or a coiled roll pin (also referred to as "a coiled spring pin," "a coiled tension pin," "a spiral pin," or the like), or the like. Here, each of the at least one second pin may be inserted into (or passed through) a set of the at least one first hole 115, the at least one second hole 130, and the at least one third hole (not shown). Alternatively, each of the at least one second pin may be inserted into (or passed through) a set of the at least one third hole and the outer one of the at least one first hole 115 or the at least one second hole 130. In other words, the at least one second pin releasably affixes to one or more of the at least one first hole 115 or the at least one second hole 130 through at least one third hole of the plurality of third holes, when the noise suppressor 100 is assembled and when the blank firing adapter 200 is coupled to the noise suppressor 100. In some embodiments, one or more of the at least one pin 160 and one or more of the at least one second pin might be the same at least one pin. In some instances, each of the plurality of third holes has shape comprising one of circular or oval, or the like.

In use, even if a live round bullet is fired by the firearm 300 through bore 310, the bullet would enter the portion 215*b*. At the interface between the portion 215*b* and the portion 215*a*, at least a portion of the bullet might be stripped due to the interface into the smaller diameter portion 215*a*, thereby bleeding forward momentum and forward kinetic energy of the bullet. The high-pressure gases are channeled or exhausted through the at least one vent hole 225 into the blast chamber 140 of the noise suppressor 100. In this manner, the BFA 200 can also withstand live fire rounds, even when fired in full automatic mode. This is unlike conventional blank firing adapters or suppressors for blanks. Of course, the BFA 200, being capable of stopping live fire rounds in full automatic mode, is also capable of stopping blanks.

To disassemble the noise suppressor system 400, a user would rotate the noise suppressor 100 relative to the barrel 305 of firearm 300, thereby disconnecting the noise suppressor 100 and the attached BFA 200 from the firearm 300. In some non-limiting embodiments, the connector 120*a* might have a head portion that is embodied by a hex head (as shown in FIG. 1) or the like. The user would subsequently disconnect the BFA 200 from the noise suppressor 100 by rotating the head portion 205*b* of the outer end cap 205 relative to the distal end cap 125 of the noise suppressor 100. In some non-limiting embodiments, the head portion 205*b* may be embodied by a hex head (as shown in FIG. 6) or the like. Appropriate tools, such as wrenches (e.g., hex wrenches or the like), pliers, etc. may be used. In the cases where the at least one second pin is used as a secondary retention system for the BFA 200, the user would first remove the at least one second pin from the at least one third hole, prior to rotating the head portion 205*b* of the outer end cap 205 relative to the distal end cap 125. Once the threading 230 and the threading 175 are no longer in contact with each other, the rod 210 may be extracted from the bore holes 165 and 170.

To disassemble the noise suppressor 100, the user first removes the at least one pin 160 from the at least one first hole 115 and the at least one second hole 130. The user then rotates the distal end cap 125 relative to the outer tube 110. In some non-limiting embodiments, the distal end cap 125 might have a head portion that is embodied by a hex head (as shown in FIG. 1) or the like, not unlike the head portion 205*b* of the outer end cap 205. Once the threading 150 and the threading 155 are no longer in contact with each other, the distal end cap 125 may be extracted from the outer tube 110. With the distal end cap 125 removed from the outer tube 110, the plurality of baffles 145*a*-145*f* may be removed.

Assembly of the noise suppressor 100 and of the noise suppressor system 400 is performed by reversing the steps for disassembly as described above.

Here, the central axis 105, the outer tube 110, the proximal end 110*a* and the distal end 110*b* of the outer tube 110, the plurality of first holes 115, the proximal end cap 120 and the connector 120*a*, the distal end cap 125, the plurality of second holes 130, the plurality of ribs or grips 135, the blast chamber 140, the plurality of baffles 145, the threading 150 on a circumferential surface of the distal end 110*b*, the threading 155 on a circumferential surface of the distal end cap 125, the at least one pin 160, the bore holes 165 in the baffles 145, the bore hole 170 in the distal end cap 125, and the threading 175 on the inner surface of the bore hole 170 in the distal end cap 125 of noise suppressor 100 as shown in FIG. 5 are similar, if not identical, to the corresponding components having the same reference numerals in FIG. 3 (with some of these components also being shown and described above with respect to FIGS. 1 and/or 2). Thus, the descriptions of the corresponding components with reference to FIG. 3 (and in applicable cases, FIGS. 1 and/or 2) are likewise applicable to these components in FIG. 5.

In a similar manner, the outer end cap 205, the rod 210, the inner bore hole 215, and the at least one vent hole 225 of BFA 200 as shown in FIG. 5 are similar, if not identical, to the corresponding components having the same reference numerals in FIG. 4. Thus, the descriptions of the corresponding components with reference to FIG. 4 are likewise applicable to these components in FIG. 5.

FIG. 6 shows a top perspective view of the noise suppressor system 400 of FIG. 5. The components of each of the noise suppressor 100, the BFA 200, and the barrel portion of the firearm 300 are as described above with respect to one or more of FIGS. 1-5.

While certain features and aspects have been described with respect to exemplary embodiments, one skilled in the art will recognize that numerous modifications are possible. Consequently, although several exemplary embodiments are described above, it will be appreciated that the invention is intended to cover all modifications and equivalents within the scope of the following claims.

What is claimed is:

1. A noise suppressor for a firearm, comprising:

a central axis;

an outer tube comprising a proximal end and a distal end, the outer tube further comprising a plurality of first holes spaced apart from each other along a circumference of the distal end;

a blast chamber;

a plurality of baffles, the plurality of baffles being disposed along the central axis, each of the plurality of baffles comprising a bore aligned along the central axis when the noise suppressor is assembled;

a proximal end cap;

a distal end cap, the distal end cap comprising a plurality of second holes spaced apart from each other along a circumference of the distal end cap, wherein the distal end cap couples to the distal end of the outer tube via threading on a circumferential surface on one of the distal end cap or the distal end and via complementary threading on a circumferential surface on the other of the distal end cap or the distal end; and at least one pin, each pin of the at least one pin passing through at least one first hole of the plurality of first holes and at least one second hole of the plurality of second holes, each pin being releasably affixed to one or more of the at least one first hole or the at least one second hole, when the noise suppressor is assembled.

2. The noise suppressor of claim 1, wherein each of the at least one pin comprises one of a slotted roll pin or a coiled roll pin.

3. A noise suppressor for a firearm, comprising:

a central axis;

an outer tube comprising a proximal end and a distal end, the outer tube further comprising a plurality of first holes spaced apart from each other along a circumference of the distal end;

a blast chamber;

a plurality of baffles, the plurality of baffles being disposed along the central axis;

a proximal end cap;

a distal end cap, the distal end cap comprising a plurality of second holes spaced apart from each other along a circumference of the distal end cap; and at least one pin, each pin of the at least one pin passing through at least one first hole of the plurality of first holes and at least one second hole of the plurality of second holes, each pin being releasably affixed to one or more of the at least one first hole or the at least one second hole, when the noise suppressor is assembled.

4. The noise suppressor of claim 3, wherein each of the at least one pin comprises one of a slotted roll pin or a coiled roll pin.

5. The noise suppressor of claim 3, wherein the plurality of first holes comprises a first number of holes that are spaced equidistant from each other along the circumference of the distal end of the outer tube, wherein the plurality of second holes comprises a second number of holes that are spaced equidistant from each other along the circumference of the distal end cap, the second number of holes being different from the first number of holes.

6. The noise suppressor of claim 5, wherein the distal end cap couples to an inner circumferential surface of the distal end of the outer tube via threading on an outer circumferential surface of the distal end cap and complementary threading on the inner circumferential surface of the distal end of the outer tube.

7. The noise suppressor of claim 6, wherein the second number of holes is greater than the first number of holes.

8. The noise suppressor of claim 6, wherein each of the plurality of second holes has a circular shape, wherein each of the plurality of first holes has an oval shape.

9. The noise suppressor of claim 6, wherein each of the at least one pin has a first end and threading on the first end, wherein each of the plurality of second holes comprises complementary threading for coupling with the threading on the first end of one of the at least one pin.

10. The noise suppressor of claim 5, wherein the distal end cap couples to an outer circumferential surface of the distal end of the outer tube via threading on an inner circumferential surface of the distal end cap and complementary threading on the outer circumferential surface of the distal end of the outer tube.

11. The noise suppressor of claim 10, wherein the first number of holes is greater than the second number of holes.

12. The noise suppressor of claim 10, wherein each of the plurality of first holes has a circular shape, wherein each of the plurality of second holes has an oval shape.

13. The noise suppressor of claim 10, wherein each of the at least one pin has a first end and threading on the first end, wherein each of the plurality of first holes comprises complementary threading for coupling with the threading on the first end of one of the at least one pin.

14. A blank firing adapter for a firearm, comprising:

an outer end cap that couples to a distal end cap of a noise suppressor, when the blank firing adapter is coupled to the noise suppressor, the noise suppressor further comprising a plurality of baffles that are disposed along a central axis when the noise suppressor is assembled;

a rod comprising a distal end and a proximal end, the distal end being affixed to the outer end cap, and the rod being disposed through a bore of each of the plurality of baffles when the blank firing adapter is coupled to the noise suppressor;

an inner bore hole that is disposed within the proximal end of the rod and that is disposed longitudinally along an axis of the rod, at least a portion of the inner bore hole having an inner diameter that is less than an outer diameter of a bullet that is fired by a firearm to which the noise suppressor is removably affixed when the blank firing adapter is coupled to the noise suppressor and when the noise suppressor is coupled to the firearm, the inner diameter being less than an outer diameter of the rod; and at least one vent hole that is disposed through a side wall of the inner bore hole.

15. The blank firing adapter of claim 14, wherein the distal end cap comprises a bore hole that is aligned along the central axis when the noise suppressor is assembled, the distal end cap further comprising threading on an inner circumference of the bore hole, wherein the blank firing adapter further comprises complementary threading on at least a portion of the distal end of the rod for coupling with the threading on the inner circumference of the bore hole of the distal end cap.

16. The blank firing adapter of claim 15, wherein the complementary threading on the at least a portion of the distal end of the rod comprises a slot that runs transverse to the threading and parallel to the axis of the rod, wherein the slot defines a vent hole through the outer end cap.

17. The blank firing adapter of claim 14, wherein the noise suppressor further comprises:

an outer tube comprising a proximal end and a distal end, the outer tube further comprising a plurality of first holes spaced apart from each other along a circumference of the distal end; and at least one first pin;

wherein the distal end cap further comprises a plurality of second holes spaced apart from each other along a circumference of the distal end cap, wherein each first pin of the at least one first pin passes through at least one first hole of the plurality of first holes and at least one second hole of the plurality of second holes, each first pin being releasably affixed to one or more of the at least one first hole or the at least one second hole, when the noise suppressor is assembled.

18. The blank firing adapter of claim 17, further comprising:

at least one second pin;

wherein the outer end cap comprises:

a cylindrical side wall that surrounds at least a portion of the distal end of the outer tube and at least a portion of the distal end cap; and a plurality of third holes spaced apart from each other along a circumference of the cylindrical side wall, wherein the at least one second pin releasably affixes to the one or more of the at least one first hole or the at least one second hole through at least one third hole of the plurality of third holes, when the noise suppressor is assembled and when the blank firing adapter is coupled to the noise suppressor.

19. The blank firing adapter of claim 18, wherein one or more of the at least one first pin and one or more of the at least one second pin are the same at least one pin.

20. The blank firing adapter of claim 18, wherein each of the at least one first pin and each of the at least one second pin each comprises one of a slotted roll pin or a coiled roll pin.

21. The blank firing adapter of claim 18, wherein each of the plurality of third holes has a shape comprising one of circular or oval.

22. A noise suppressor system for a firearm, comprising:

a noise suppressor for a firearm, comprising:

a central axis;

an outer tube comprising a proximal end and a distal end, the outer tube further comprising a plurality of first holes spaced apart from each other along a circumference of the distal end;

a blast chamber;

a plurality of baffles, the plurality of baffles being disposed along the central axis, each of the plurality of baffles comprising a bore aligned along the central axis when the noise suppressor is assembled;

a proximal end cap;

a distal end cap, the distal end cap comprising a plurality of second holes spaced apart from each other along a circumference of the distal end cap; and at least one first pin, each first pin of the at least one first pin passing through at least one first hole of the plurality of first holes and at least one second hole of the plurality of second holes, each first pin being releasably affixed to one or more of the at least one first hole or the at least one second hole, when the noise suppressor is assembled, a blank firing adapter, comprising:

an outer end cap that couples to the distal end cap, when the blank firing adapter is coupled to the noise suppressor;

a rod comprising a distal end and a proximal end, the distal end being affixed to the outer end cap, and the rod being disposed through the bore of each of the plurality of baffles when the blank firing adapter is coupled to the noise suppressor;

an inner bore hole that is disposed within the proximal end of the rod and that is disposed longitudinally along an axis of the rod, at least a portion of the inner bore hole having an inner diameter that is less than an outer diameter of a bullet that is fired by a firearm to which the noise suppressor is removably affixed when the blank firing adapter is coupled to the noise suppressor and when the noise suppressor is coupled to the firearm, the inner diameter being less than an outer diameter of the rod; and at least one vent hole that is disposed through a side wall of the inner bore hole.

23. The noise suppressor system of claim 22, wherein the distal end cap comprises a bore hole that is aligned along the central axis when the noise suppressor is assembled, the distal end cap further comprising threading on an inner circumference of the bore hole, wherein the blank firing adapter further comprises complementary threading on at least a portion of the distal end of the rod for coupling with the threading on the inner circumference of the bore hole of the distal end cap.

24. The noise suppressor system of claim 23, wherein the complementary threading on the at least a portion of the distal end of the rod comprises a slot that runs transverse to the threading and parallel to the axis of the rod, wherein the slot defines a vent hole through the outer end cap.

25. The noise suppressor system of claim 22, wherein the blank firing adapter further comprises at least one second pin, wherein the outer end cap comprises:

a cylindrical side wall that surrounds at least a portion of the distal end of the outer tube and at least a portion of the distal end cap; and a plurality of third holes spaced apart from each other along a circumference of the cylindrical side wall, wherein the at least one second pin releasably affixes to the one or more of the at least one first hole or the at least one second hole through at least one third hole of the plurality of third holes, when the noise suppressor is assembled and when the blank firing adapter is coupled to the noise suppressor.

26. The noise suppressor system of claim 25, wherein one or more of the at least one first pin and one or more of the at least one second pin are the same at least one pin.

27. The noise suppressor system of claim 25, wherein each of the at least one first pin and each of the at least one second pin each comprises one of a slotted roll pin or a coiled roll pin.

28. The noise suppressor system of claim 25, wherein each of the plurality of third holes has shape comprising one of circular or oval.

* * * * *